US006564430B2

(12) United States Patent
Graf

(10) Patent No.: US 6,564,430 B2
(45) Date of Patent: May 20, 2003

(54) APPARATUS FOR PROCESSING TEXTILE FIBERS

(75) Inventor: Ralph A. Graf, Freienbach (CH)

(73) Assignee: Graf + Cie AG, Rapperswil (CH)

( * ) Notice: Subject to any disclaimer, the term of this patent is extended or adjusted under 35 U.S.C. 154(b) by 0 days.

(21) Appl. No.: 10/099,475

(22) Filed: Mar. 14, 2002

(65) Prior Publication Data

US 2002/0157216 A1 Oct. 31, 2002

(30) Foreign Application Priority Data

Mar. 14, 2001 (DE) ..... 101 12 301

(51) Int. Cl.[7] ..... D01G 15/00
(52) U.S. Cl. ..... 19/98; 19/105; 19/205
(58) Field of Search ..... 19/98, 65 R, 100, 19/101, 102, 104, 105, 106 R, 108, 110, 111, 112, 113, 114, 200, 203, 204

(56) References Cited

U.S. PATENT DOCUMENTS

| | | | | | |
|---|---|---|---|---|---|
| 3,737,953 | A | * | 6/1973 | Bechtel, Jr. | 19/113 |
| 4,287,643 | A | * | 9/1981 | Leifeld | 19/114 |
| 4,438,547 | A | | 3/1984 | Schmolke et al. | |
| 4,893,380 | A | * | 1/1990 | Graf | 19/114 |
| 4,974,295 | A | | 12/1990 | Demuth et al. | |
| 5,054,166 | A | | 10/1991 | Demuth et al. | |
| 5,448,800 | A | * | 9/1995 | Faas et al. | 19/108 |
| 5,530,994 | A | * | 7/1996 | Loeffler | 19/104 |
| 6,058,568 | A | * | 5/2000 | Pasini et al. | 19/105 |
| 6,101,680 | A | | 8/2000 | Näf et al. | |
| 6,219,885 | B1 | | 4/2001 | Faas et al. | |

FOREIGN PATENT DOCUMENTS

| | | |
|---|---|---|
| DE | 2816900 | 10/1979 |
| DE | 2846110 | 4/1980 |
| DE | 295673 | 11/1991 |
| DE | 9419619 | 3/1995 |
| EP | 0945531 | 9/1999 |
| GB | 2245907 | 1/1992 |
| GB | 2271126 | 4/1994 |

* cited by examiner

*Primary Examiner*—Gary L Welch
(74) *Attorney, Agent, or Firm*—Friedrich Kueffner

(57) ABSTRACT

The invention relates to an apparatus for processing textile fibers, comprising a processing element having a first working surface substantially in the form of a regular cylinder surface and rotatable preferably around the axis of the cylinder, like a take-in roller of a card., and at least one carding element having a further working surface facing the first working surface, wherein the form of the further working surface approximates that of the first working surface on a plane vertically intersecting the axis of the cylinder.

8 Claims, 5 Drawing Sheets

APPARATUS FOR PROCESSING TEXTILE FIBERS

BACKGROUND OF THE INVENTION

1. Field of the Invention

The invention relates to an apparatus for processing textile fibers, comprising a processing element having a first working surface substantially in the form of a regular cylinder surface and rotatable preferably around the axis of the cylinder, like a take-in roller of a card., and at least one carding element having a further working surface facing the first working surface, a carding element suitable for assembling such an apparatus, and support elements adapted to be used for assembling these carding elements and sawtooth wire strips.

2. Description of the Related Art

Apparatuses of the above-described type are used, for example, in the form of initial loosening sections in cards or carding combs suitable for producing a fiber fleece with uniformily aligned fibers from a fiber material with nonuniformily aligned fibers. The working of such cards or carding combs is explained below with reference to FIGS. 3 to 5. FIG. 3 shows schematically the basic structure of a card or carding comb. Accordingly, the card comprises a feeder channel generally denoted by 12 for introducing the fiber material of nonaligned fibers into an initial loosening section 20. The fiber material is transferred with this initial loosening section 20 to the cylinder 30 of the card. This cylinder is a roller which on its outer surface is provieded with a steel hook or sawtooth filleting set. During operation, the cylinder is rotated around its axis. The fibers supplied from the initial loosening section are picked up by the filleting set and aligned in the direction of rotation of the roller. In order to improve the fiber alignment, there are used rods 32 distributed circumferentially over the outer surface of the cylinder. These rods have a working surface facing the outer surface of the cylinder in the position of operation, with the working surface likewise configured as a hook and/or sawtooth filleting set made of steel. The rods can be stationary or adapted to be moved in a direction opposite to the direction of cylinder rotation. Finally, the fiber fleece is removed with a doffing cylinder 40 and transported to further processing. In the card described with reference to FIG. 3, the initial loosening section serves, on the one hand, for controlled feeding of the disorderd fiber material to the cylinder and, on the other hand, for uniformly distributing the fiber material over the entire axial length of the cylinder.

FIG. 4 shows in detail this initial loosening section 20. In the loosening section 20 shown in the figure, there are provided a total of three initial take-in rollers 22, 24, and 26 rotatable around the roller axes 22*a*, 24*a*, and 26*a* in the directions indicated by the arrows A. Each of the take-in rollers 22, 24, and 26 has a working surface in the form of the outer surface of a regular cylinder, which may be provided with a steel hook or sawtooth filleting set. Particularly in the case of high-output cards and high-output carding combs for processing short-staple and long-staple textile fibers of natural or synthetic polymers, it is common practice to associate so-called stationary carding elements 23, 25, and 27 with the various take-in rollers 22, 24, and 26 in order to improve the fiber distribution. The arrangement of these stationary carding elements is shown in FIG. 5 as an example for the stationary carding element 27. FIG. 5*a* is a section along a plane vertical to the axis 26*a* of the roller and FIG. 5*b* is a top view of the stationary carding element 27.

It can be seen in FIG. 5*a* that the stationary carding element 27 is formed basically by a support element 27*a* and sawtooth wire sections 27*b* affixed to this support element 27*a*. These sawtooth wire sections 27*b* extend approximately tangentially to the outer surface of the take-in roller 26 which is likewise provided with a steel sawtooth set. As shown in FIG. 5*b*, the stationary carding element has a plurality of sawtooth wire sections arranged in side-by-side relationship and attached to the support element 27*a*. In conventional cards, the stationary carding elements have a width of about 32 to 52 mm and are made from cast iron, steel, aluminium, magnesium or synthetic materials; between the tips of the sawtooth wire strips 27*b* and those of the set of take-in rollers there is maintained a minimum spacing of the order of 0.1 to 1.0 mm. In the region of the greatest approach of the sawtooth wire strips 27*b* to the filleting set of the take-in roller 26, there takes place levelling of the fibers, and this causes a first alignment of the fiber material and uniform distribution of this fiber material. The width of the zone along which levelling of the fibers takes place corresponds approximately to the average fiber length of the fiber material introduced.

When the cards shown in FIGS. 3 to 5 were used, it was observed that nonuniform fiber distribution may occur in the fiber fleece taken from the doffing cylinder 40, particularly at high processing rates.

SUMMARY OF THE INVENTION

In view of these problems of the state of the art, the problem underlying the invention is to provide an apparatus of the above-described type with which even at high processing rates uniform fiber distribution can be obtained in the fiber fleece taken from the card or carding comb and to design a carding element suitable for assembling such an apparatus and to provide suitable support elements and sawtooth wire strips for such a carding element.

According to the invention, this problem is solved by further development of the known apparatus, characterised basically in that the form of the further working surface of the carding element approximates the form of the processing element's, like the taker-in's, first working surface having basically the form of the outer surface of a regular cylinder on a plane vertically intersecting the axis of the cylinder.

The invention resides on the finding that the nonuniform distribution of the fibers in the fiber fleece taken with the doffing roller from the cylinder results already from the fiber processing in the region of the initial loosening section, because, as a consequence of the tangential approach of the working surface of the stationary carding element to the corresponding roller sets, there is available only a very narrow zone in which effective fiber levelling occurs so that the resulting distribution of the fibers is not adequate in each instance. In the inventive development of the known apparatus, the zone in which effective fiber levelling can take place is enlarged by approximating the form of the working surface of the carding element to the cylinders' working surface in the form of the outer surface of a regular cylinder so that an overall improved fiber distribution is obtained. It turned out that the air turbulence, which is caused by approximating the form of the working surface of the carding elements to the form of the outer surface of a regular cylinder, is acceptable in the zone of the effective fiber levelling in view of the improved enlargement of this zone.

In principle, the approximation of the working surface of the carding elements to the form of the outer surface of a regular cylinder can be obtained by any concave shape of this working surface. In particular, there can be considered an arched form of the carding element's working surface coaxial with the first working surface in order to provide a particularly wide zone in which effective fiber levelling can take place. With a view to obtaining the lowest possible air turbulence in the region of the fiber levelling zone while enlarging the same at the same time, it proved to be particularly convenient to approximate the working surface of the carding elements to the first working surface in the form of the outer surface of a regular cylinder by a polygonal progression having polygon sections approximately tangential to the first working surface on the plane intersecting the cylinder axis under a right angle. In this way, there can be provided two or more fiber levelling zones to increase in this way the overall Zone of effective fiber levelling; the approximation of the working surface of the carding element to the working surface in the form of the outer surface of a regular cylinder is in each of these zones almost point-like, whereby the overall air turbulence caused by this approximation can be kept particularly low.

In a preferred embodiment of the invention, two effective fiber levelling zones are provided by configuring the working surface of the carding element as two polygon sections including an obtuse angle on a plane extending perpendicular to the axis of the cylinder. The working surface in the form of the outer surface of a regular cylinder and/or the additional working surface of the carding element can be formed by one or more sawtooth wire sections; the additional working surface of the carding element is conveniently formed by a plurality of sawtooth wire sections arranged in side-by-side relationship. In this embodiment of the invention, the additional working surface of the carding element of the inventive apparatus can be made without increasing the number of the sawtooth wire sections in comparison with the number of sawtooth wire strips required for the assembly of conventional carding elements, if at least one of the sawtooth wire sections forming the additional working surface has segments including an obtuse angle inbetween. The apparatus according to the invention can be used, for example, in an initial loosening section in which the carding element is mounted in the form of a take-in roller stationary relative to the optionally rotatable processing element. Apart from that, it is also contemplated to use inventive apparatuses in which the processing element forms the cylinder of a card while the carding element is a cover rod optionally designed as a revolving flat card.

As can be inferred from the above description of inventive apparatuses, an inventive carding element has at least one working surface and is basically characterised in that this working surface has a concave form approximating the outer surface of a regular cylinder, wherein this working surface can have two or more polygon sections including an obtuse angle of 160° to 170°, preferably about 165°, on a plane intersecting the cylinder axis under a right angle. The inventive carding element conveniently comprises a rigid or flexible raising-card segment which forms the one working surface and is affixed to a support element of the carding element. The raising-card segments of the inventive carding element can comprise at least one sawtooth wire section having two segments including an obtuse angle of preferably about 160° to 170°, particularly preferred about 165°, with the support element comprising corresponding support surfaces including an obtuse angle for the raising-card segment. Between these two support surfaces there may be provided a recess in the support element for attaching therein sawtooth wire sections provided with a kink. The support element may have basic V, W or multi-W form. As can be inferred from the above description of the inventive carding elements, a support element suitable for their assembly is basically characterised in that it has two support surfaces for the raising-card segment which include an obtuse angle. A sawtooth wire section suitable for the assembly of inventive carding elements is basically characterised in that it has two segments including an obtuse angle and that between these segments there may be provided a connecting segment which has a kink and is without teeth.

BRIEF DESCRIPTION OF THE DRAWINGS

In what follows, the invention is described with reference to the drawing to which specific reference is made in regard to all details which are essential for the invention and are not described in greater detail in the specification. In the drawings, there show:

FIG. 1 shows an inventive apparatus 100 as part of the initial loosening section of a card. FIG. 1*a* is a section on a plane extending perpendicular to the axis of the take-in roller and FIG. 1*b* is a view of the carding element shown in FIG. 1*a*. According to FIG. 1*a* the apparatus comprises a take-in roller 110, only part the working surface of which in the form of the outer surface of a regular cylinder is shown, and a carding element. The carding element comprises a support element 120 and a plurality of sawtooth wire strips 130 arranged in side-by-side relationship. The arrangement of the sawtooth wire strips can be recognised particularly clearly in the view of FIG. 1*b*. The sawtooth wire sections 130 have two segments 132 and 134 which include an obtuse angle and are joined through a connecting segment 136. The connecting segment 136 has a kink corresponding to the obtuse angle and is without sawteeth in order to facilitate the forming of the kink.

Figure 1A:
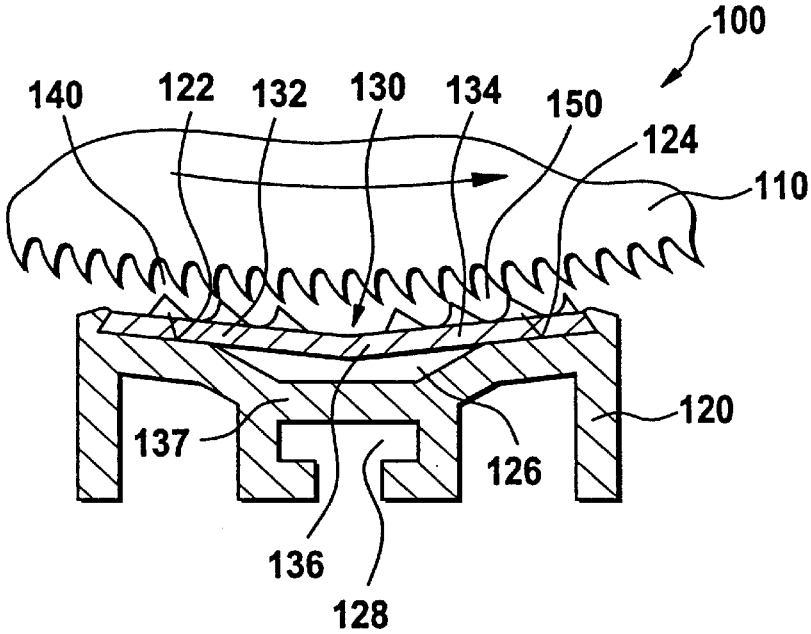
FIGS. 1*a* and 1*b* are schematic representations of an apparatus according to the invention.

The support element 120 has two support surfaces 122 and 124 for the segments 132 and 134. These support surfaces are flat and include an obtuse angle conforming to the sawtooth wire sections. Between the support surfaces 122 and 124 there is provided a recess 126 to accommodate the bent connecting segment 136. The support element 120 is basically W-shaped. The recess 126 is delimited by a bridge 137 on the side far from the sawtooth wire section 130. On the bridge's 137 side far from the sawtooth wire sections 130 there is provided a further downwardly opening recess 128 of T-shaped cross section for accommodating a matching attachment element.

Figure 1B:
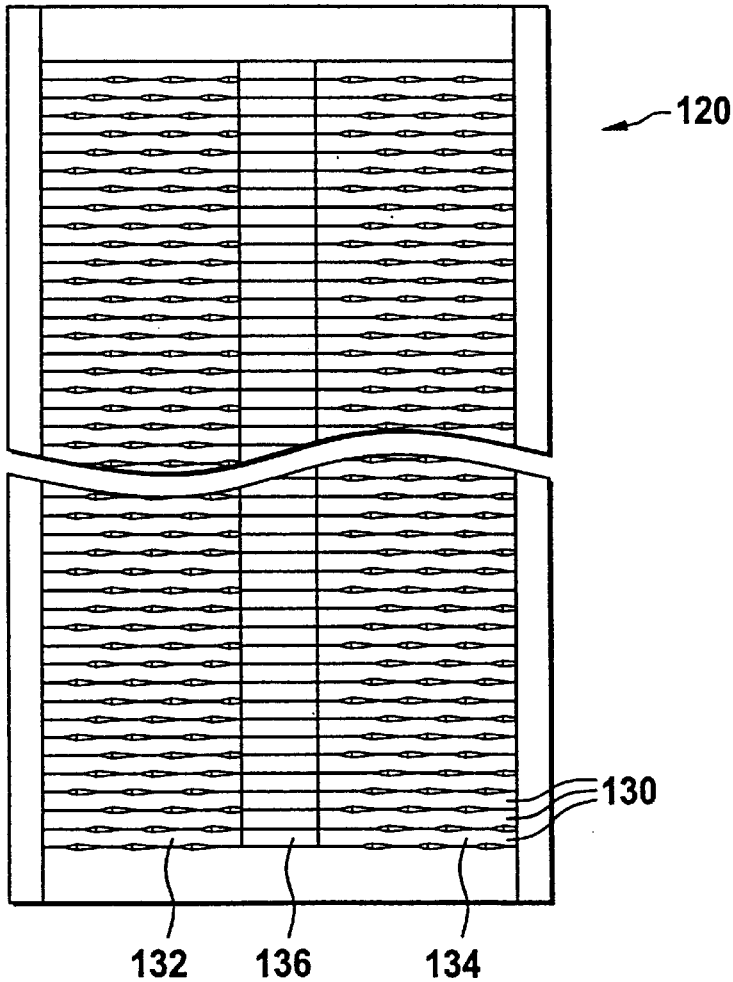

The embodiment of the carding element shown in FIG. 1 defines two fiber-levelling zones 140 and 150 between the set or the take-in roller 110 and the stationary carding element.

Figure 2B:
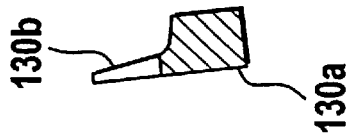
FIGS. 2*a* and 2*b* a sawtooth wire section suitable for assembling the apparatus shown in FIG. 1.
Figure 2A:
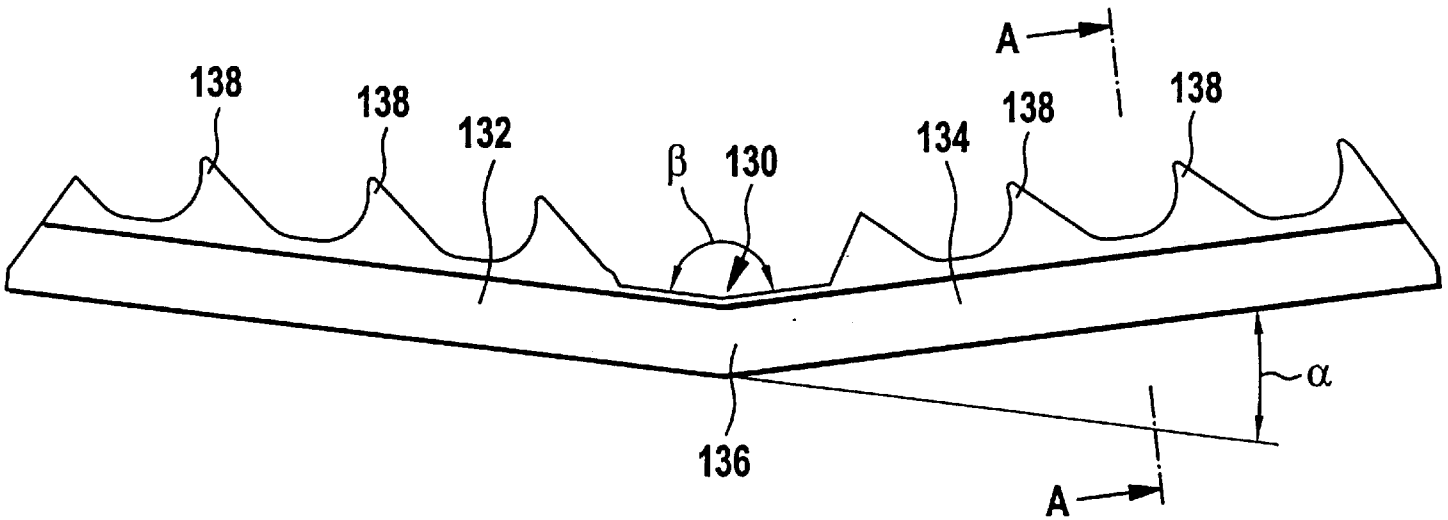
Figure 3:
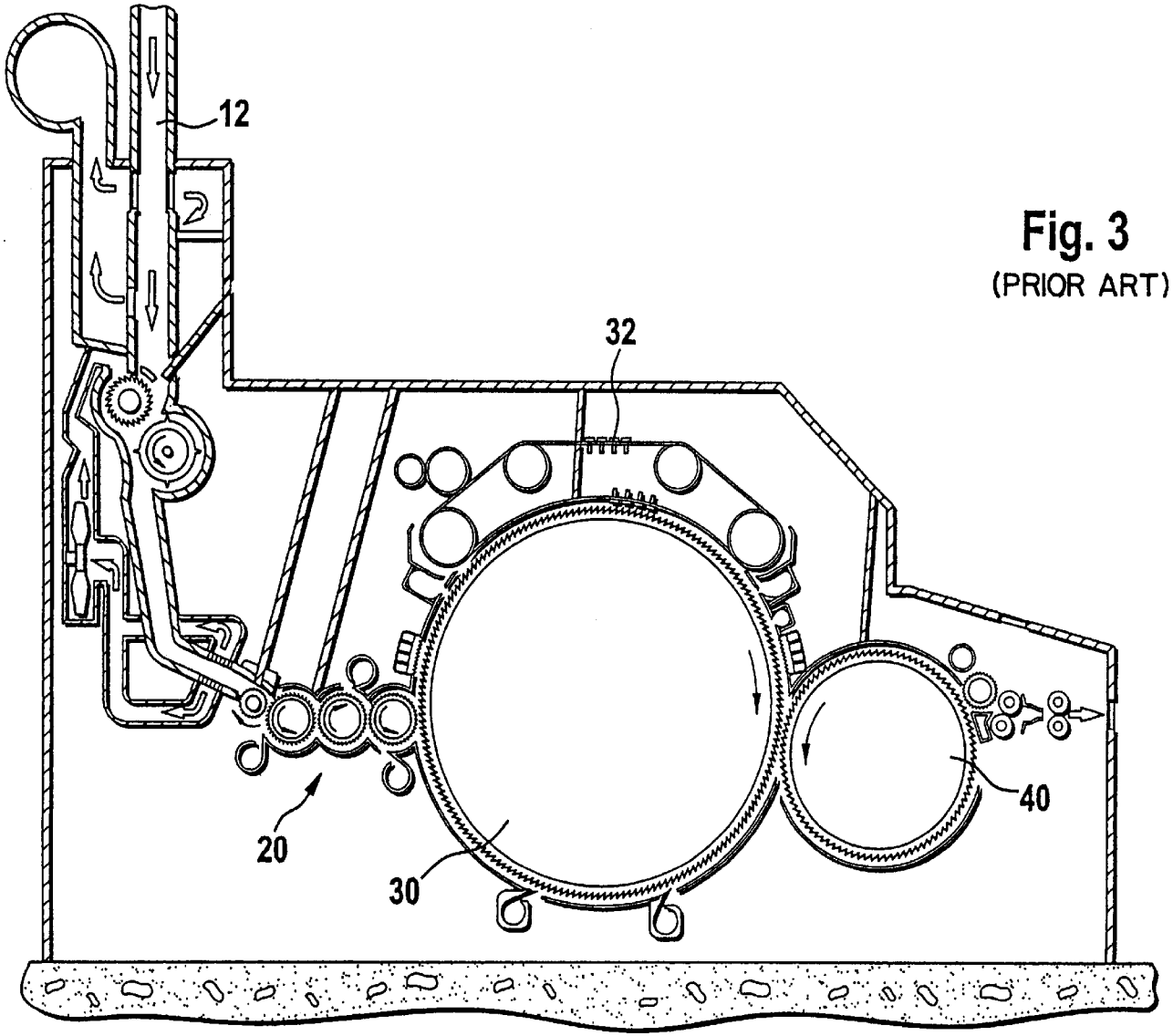
Fig. 3 (PRIOR ART)
FIG. 3, a state-of-the-art card.
Figure 4:
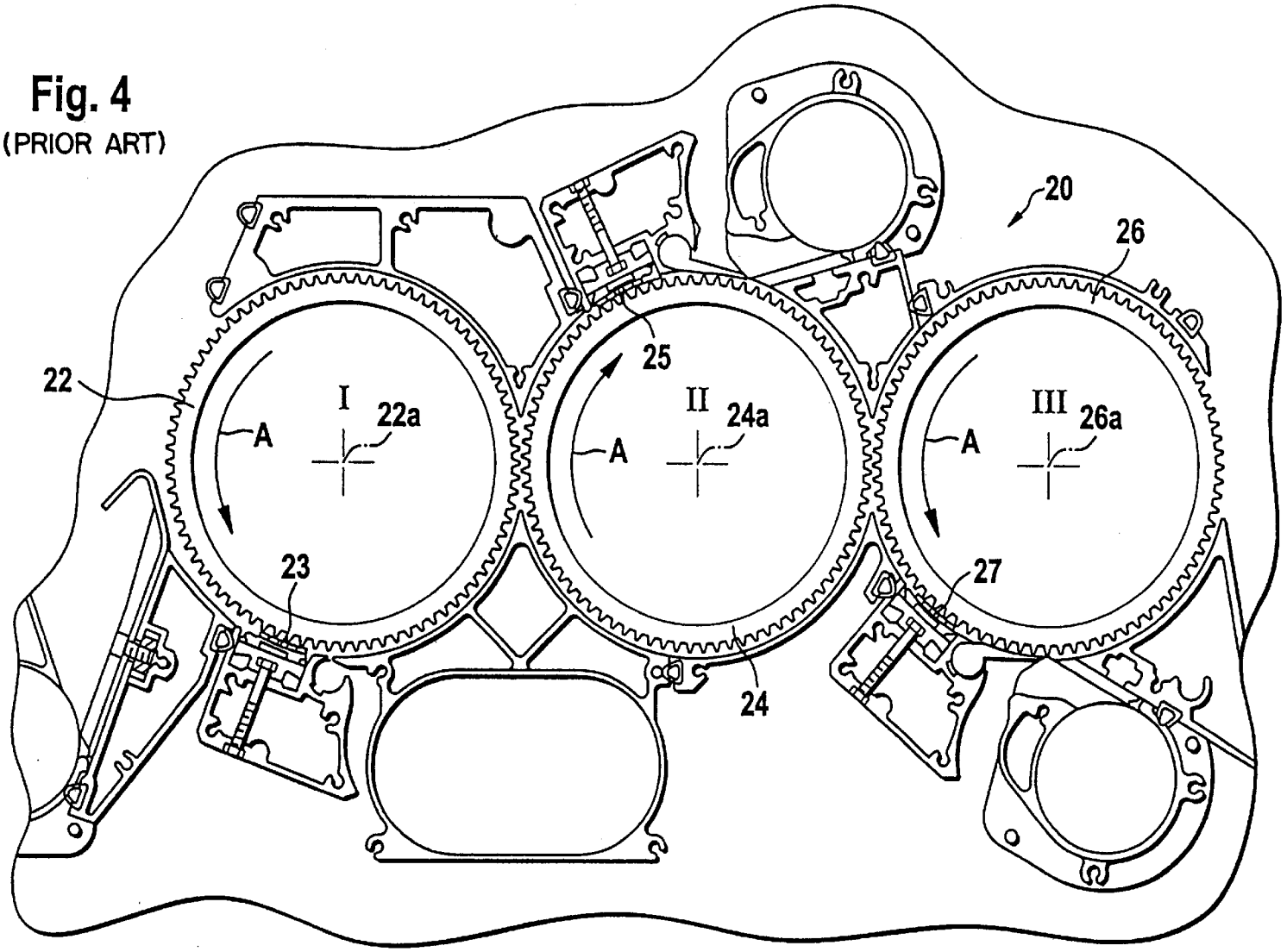
Fig. 4 (PRIOR ART)
FIG. 4, a detailed view of the initial loosening section of the card shown in FIG. 3.
Figure 5A:
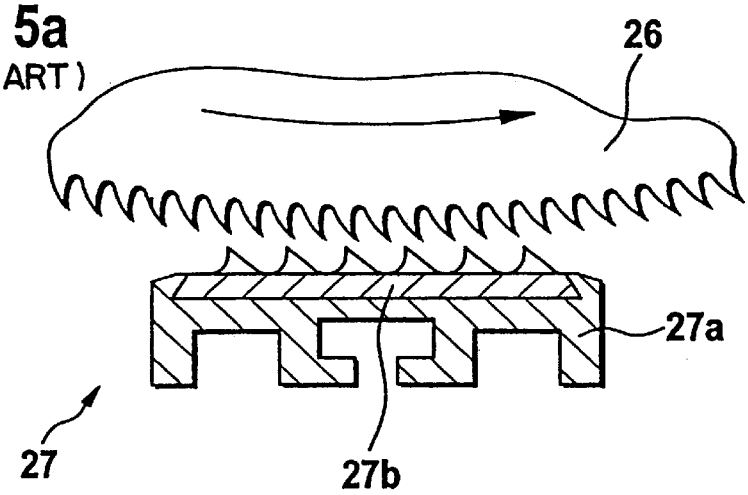
Fig. 5a (PRIOR ART)
FIGS. 5*a* and 5*b* a detailed view of the stationary carding elements of the card shown in FIG. 3.
Figure 5B:
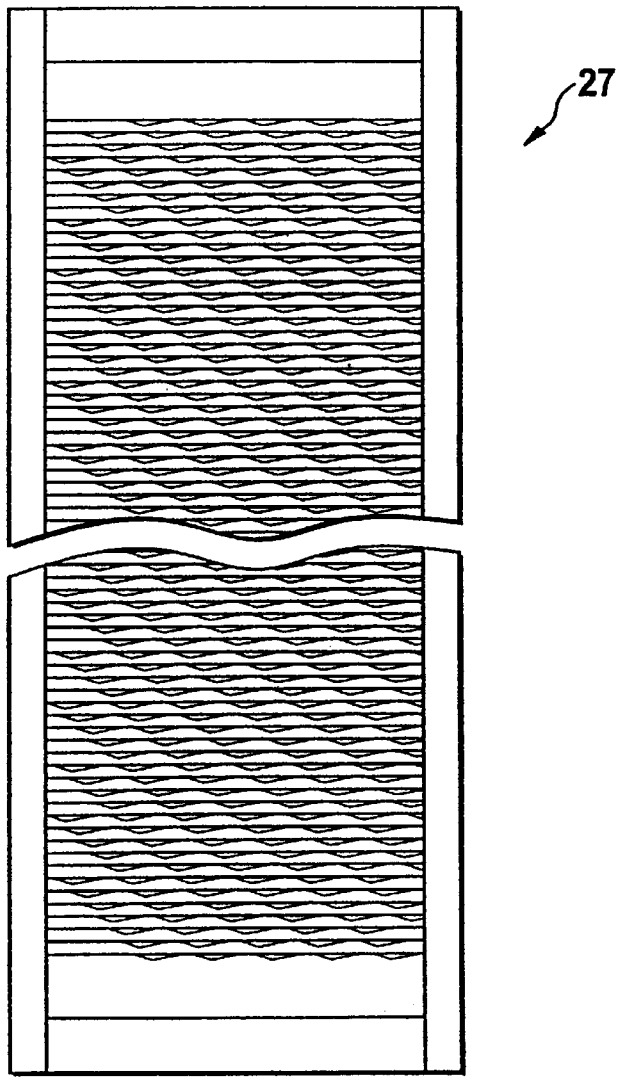
Fig. 5b (PRIOR ART)

FIG 2 is a detailed view of the sawtooth wire sections 130 of FIG. 1. FIG. 2*a* is a side view of the sawtooth wire sections, whereas FIG. 2*b* is a section along the plane A—A of FIG. 2*a*. In the embodiment of the invention illustrated in FIG. 2, the extension of the segment 132 includes an angle $\alpha$ of about 15° with the segment 134. This means that the segments 132 and 134 include an angle β of about 165°. The angle α of 15° is used for taker-in diameters of about 180 mm. In the case of larger diameters of the taker-in, substantially smaller angles may be used. As can be seen particularly clearly in FIG. 2*a*, each of the segments 132 and 134 has a number of sawteeth 138 arranged one behind the other, whereas the connecting segment 136 is without sawteeth. In the section of FIG. 2*b*, it is recognized that the sawtooth wire section 130 has a foot portion 130*a* and a blade portion 130*b*; the sawteeth are provided within the blade portion 130*b*. The foot portion 130*a* has a greater width than the blade portion 130*b*. Therefore, in a close arrangement of a number of sawtooth wires of the type shown in FIG. 2, a path is formed between sets of blade portions 130*b*.

The invention is not limited to the embodiments described with reference to the drawings. Also carding elements having a basic V or multi-W shape are contemplated. Finally, a polygon-shape of the working surface of the carding element with more than two polygon sections is under consideration.

I claim:

1. An apparatus for processing textile fibers, the apparatus comprising a processing element having a first working surface substantially in the form of a wall surface of a circular cylinder, and at least one carding element having a further working surface facing the first working surface, wherein the form of the further working surface approximates the form of the first working surface on a plane vertically intersecting the axis of the cylinder, said further working surface being formed by a plurality of sawtooth wire sections arranged in a side-by-side relationship, each of said wire sections having at least two segments including an obtuse angle therebetween, wherein two segments are connected to one another by a bent connecting segment, each of said wire sections being affixed to a support element, each said support element comprising at least two support surfaces including an obtuse angle therebetween for respective segments of the sawtooth wire sections, further comprising a recess provided in the support element between the support surfaces.

2. The apparatus according to claim 1, wherein the processing element is rotatable about an axis of the cylinder.

3. The apparatus according to claim 2, wherein the carding element is mounted so as to be stationary relative to the processing element.

4. The apparatus according to claim 1, wherein the processing element is a take-in roller of a card.

5. A carding element for an apparatus for processing textile fibers with a processing element having a first working surface substantially in the form of a wall surface of a circular cylinder, the carding element comprising a further working surface adapted to facing the first working surface, wherein the form of the further working surface approximates the form of the first working surface on a plane vertically intersecting the axis of the cylinder, said further working surface being formed by a plurality of sawtooth wire sections arranged in a side-by-side relationship, each of said wire sections having at least two segments including an obtuse angle therebetween wherein the two segments are connected to one another by a bent connecting segment, each of said wire sections being affixed to a support element, each said support element comprising at least two support surfaces including an obtuse angle therebetween for respective segments of the sawtooth wire sections, further comprising a recess provided in the support element between the support surfaces.

6. The carding element according to claim 5, wherein the further working surface has two or more polygon sections which include an obtuse angle of 160° to 170° on a plane vertically intersecting the axis of the cylinder.

7. The carding element according to claim 5, wherein the further working surface has two or more polygon sections which include an obtuse angle of approximately 165° on a plane vertically intersecting the axis of the cylinder.

8. The carding element according to claim 5, wherein the support element has a basic V, W or multi-W shape.

* * * * *